US008176621B2

(12) United States Patent
Lo et al.

(10) Patent No.: US 8,176,621 B2
(45) Date of Patent: May 15, 2012

(54) METHOD FOR FORMING ANTENNA STRUCTURE

(75) Inventors: Wen-Kuei Lo, Hsinchu (TW); Sheng-Chieh Chang, Hsinchu (TW); Bau-Yi Huang, Hsinchu (TW); Chi-Wen Tsai, Hsinchu (TW); Hsin-Hui Hsu, Hsinchu (TW); Tzuh-Suan Wang, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 8 days.

(21) Appl. No.: 12/969,516

(22) Filed: Dec. 15, 2010

(65) Prior Publication Data

US 2012/0017427 A1 Jan. 26, 2012

(30) Foreign Application Priority Data

Jul. 26, 2010 (TW) ..... 99124483 A

(51) Int. Cl.
*H01P 11/00* (2006.01)

(52) U.S. Cl. ..... 29/600; 29/592.1; 216/13; 427/555

(58) Field of Classification Search ..... 29/592.1, 29/830–831, 846–847, 825, 829, 600; 216/13, 216/62–66, 75, 100; 343/700 MS, 5.8; 427/555–557; 455/575.1–575.5

See application file for complete search history.

(56) References Cited

U.S. PATENT DOCUMENTS

| | | | | |
|---|---|---|---|---|
| 4,322,457 | A * | 3/1982 | Baron et al. | 205/126 |
| 5,786,910 | A * | 7/1998 | Walters et al. | 359/2 |
| 6,421,011 | B1 * | 7/2002 | Van Egmond et al. | 343/700 MS |
| 6,471,878 | B1 * | 10/2002 | Greene et al. | 216/13 |
| 7,421,775 | B2 * | 9/2008 | Kwak et al. | 29/600 |
| 2006/0281500 | A1 * | 12/2006 | Huang et al. | 455/575.1 |
| 2010/0009094 | A1 * | 1/2010 | Lochtman et al. | 427/555 |
| 2012/0017427 | A1 * | 1/2012 | Lo et al. | 29/600 |

FOREIGN PATENT DOCUMENTS

TW 200845845 11/2008

* cited by examiner

*Primary Examiner* — Minh Trinh

(57) ABSTRACT

A method for forming an antenna structure is provided, including the following steps of: providing a non-conductive frame and disposing a plating resist material on the non-conductive frame, removing a part of the plating resist material within a predetermined region on the non-conductive frame and forming a roughened surface on the non-conductive frame within the predetermined region by laser marking, forming a medium layer on the roughened surface, wherein the medium layer comprises Pd or Ag, removing the plating resist material on the non-conductive frame, and forming a metal layer on the medium layer.

12 Claims, 5 Drawing Sheets

METHOD FOR FORMING ANTENNA STRUCTURE

CROSS REFERENCE TO RELATED APPILCATIONS

This Application claims priority of Taiwan Patent Application No. 099124483, filed on Jul. 26, 2010, the entirety of which is incorporated by reference herein.

BACKGROUND OF THE INVENTION

1. Field of the Invention

This application relates in general to a method for forming an antenna structure and in particular to a method for forming an antenna structure on a non-conductive frame.

2. Description of the Related Art

In conventional mobile phones, the antennas are usually thin metal pieces having specific patterns fixed to a plastic housing. The assembly process for fixing the antennas may require considerable time and production cost. To solve the aforesaid problems, simplifying the assembly process and reducing cost in producing the antennas have become important issues.

BRIEF SUMMARY OF INVENTION

This application provides a method for forming an antenna structure, including the following steps of: providing a non-conductive frame and disposing a plating resist material on the non-conductive frame, wherein a part of the plating resist material within a predetermined region on the non-conductive frame is removed and a roughened surface of the non-conductive frame within the predetermined region is formed by laser marking; forming a medium layer on the roughened surface; removing the plating resist material on the non-conductive frame, and forming a metal layer on the medium layer.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
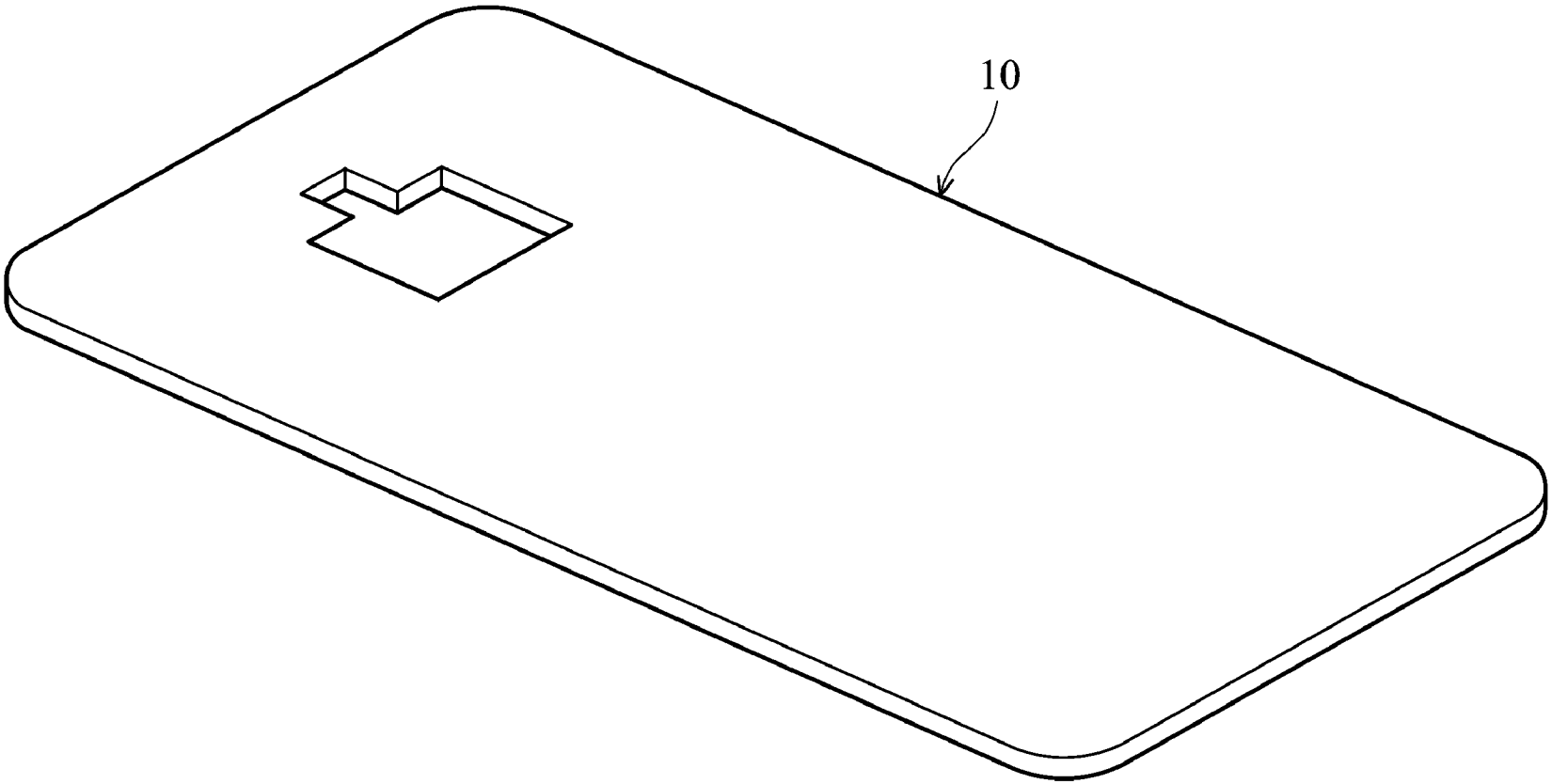
FIG. 1 is a perspective diagram of a non-conductive frame according to an embodiment of the invention.
Figure 2:
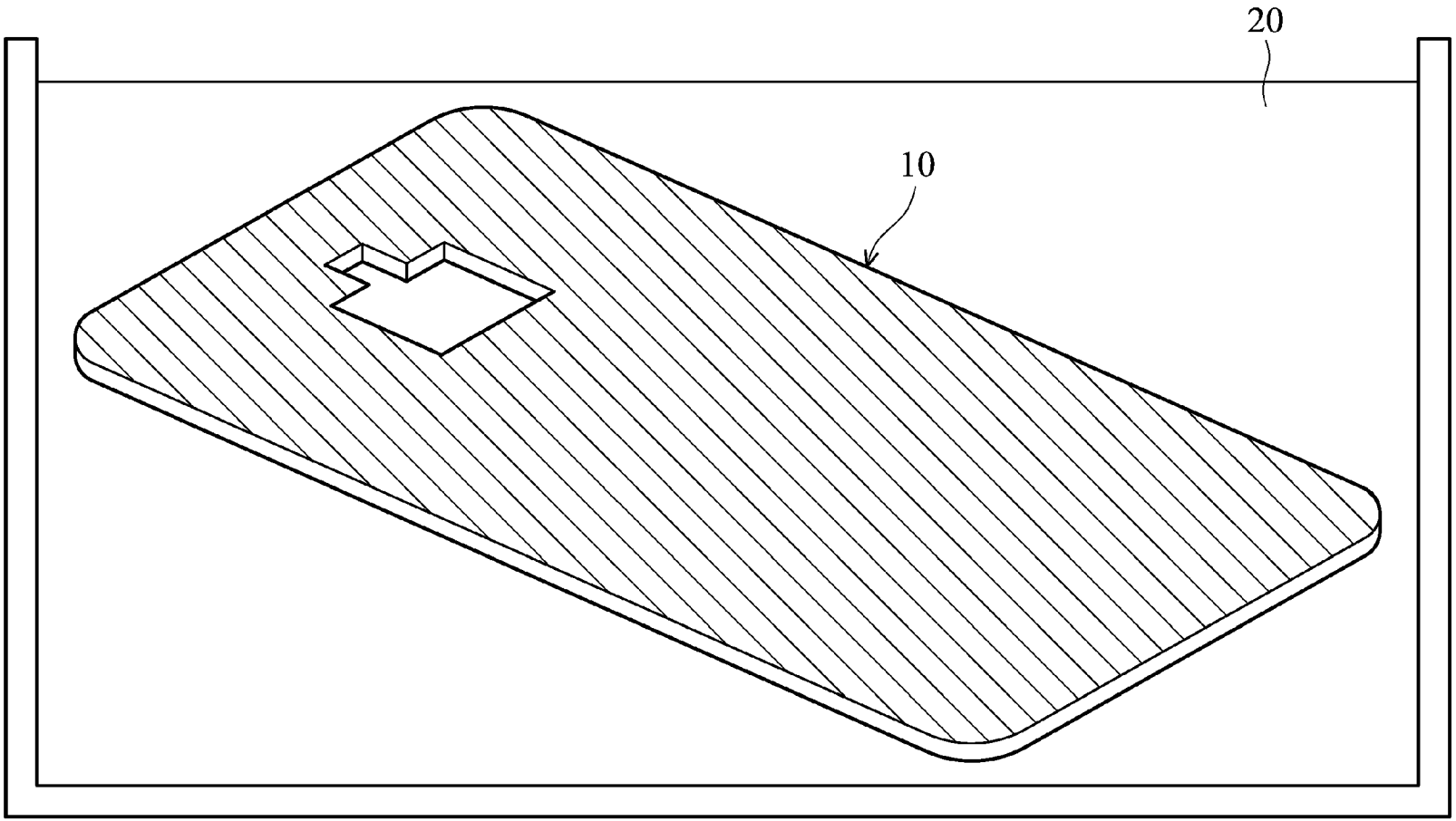
FIG. 2 is a perspective diagram of a non-conductive frame immersed in a plating resist material according to an embodiment of the invention.

An embodiment of the invention provides a method for forming a patterned antenna structure on a non-conductive frame. The non-conductive frame may be a housing of a mobile phone or other portable electronic devices. The first step of the method is to provide a non-conductive frame 10, as shown in FIG. 1. The non-conductive frame 10 may comprise polymer or plastic material integrally formed by injection molding. Subsequently, the non-conductive frame 10 can be immersed in a plating resist material 20 to form a resist layer on the non-conductive frame 10, as shown in FIG. 2. In this embodiment, the plating resist material 20 may comprise resin. Additionally, the resist layer can also be formed by spraying or daubing the plating resist material 20 on the non-conductive frame 10.

Figure 3:
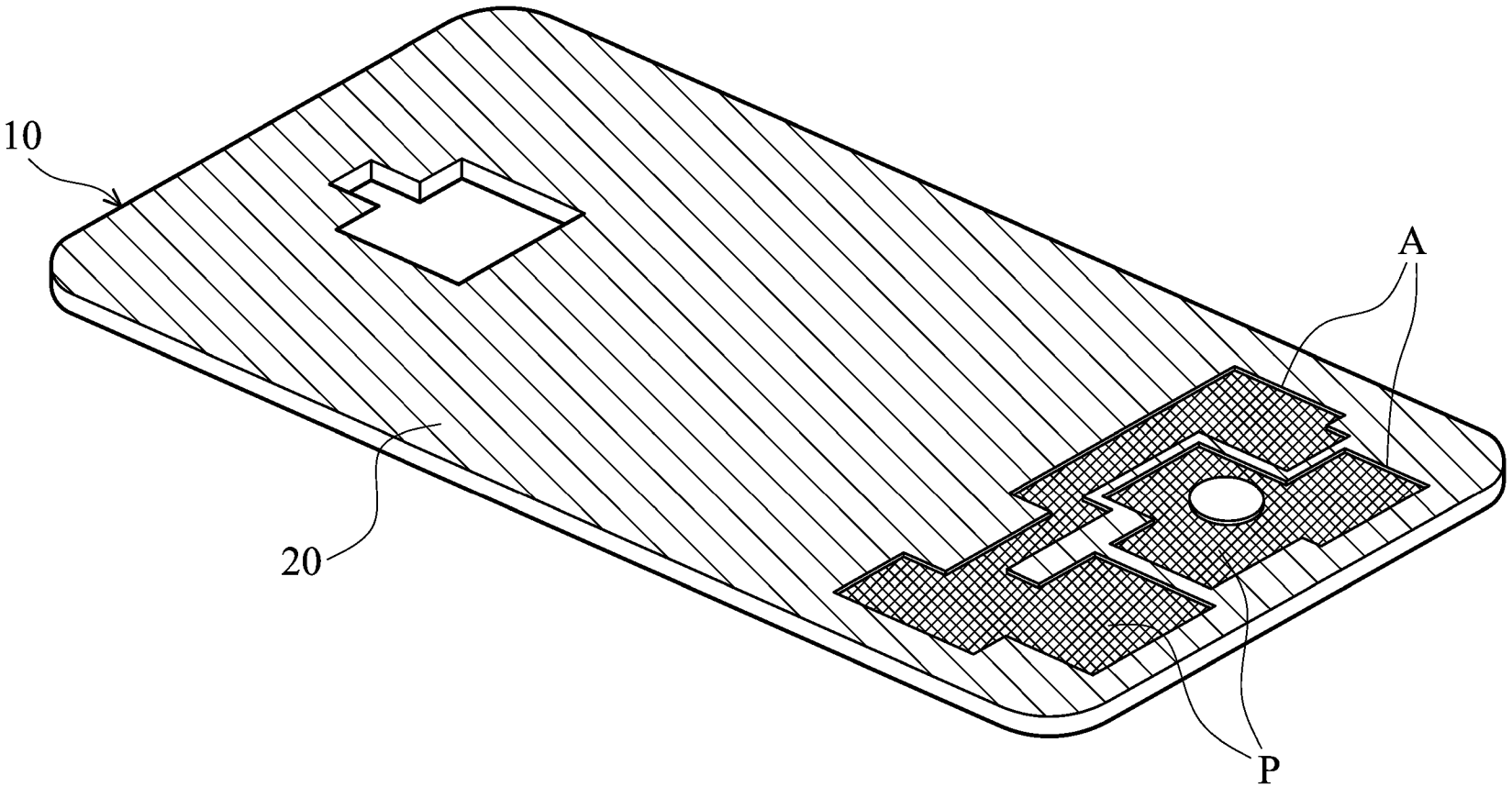
FIG. 3 is a perspective diagram of a medium layer formed on a roughened surface of the non-conductive frame within the predetermined region according to an embodiment of the invention.

Referring to FIG. 3, the plating resist material 20 within a predetermined region A on the non-conductive frame 10 can be removed by laser marking, and the exposed area of the non-conductive frame 10 within the predetermined region A can be roughened also by the laser marking process. After the steps as described above, a medium layer P is then formed on the roughened surface. In this embodiment, the medium layer P may comprise Pd, Ag or any chemical compound thereof, such as Pb/Sn colloid or $AgNO_3$. By forming the roughened surface on the non-conductive frame 10, the medium layer P can be firmly bonded to the non-conductive frame 10, as shown in FIG. 3. Thus, a patterned antenna structure which is consistent with the predetermined region A can be produced by electroless deposition.

Figure 4:
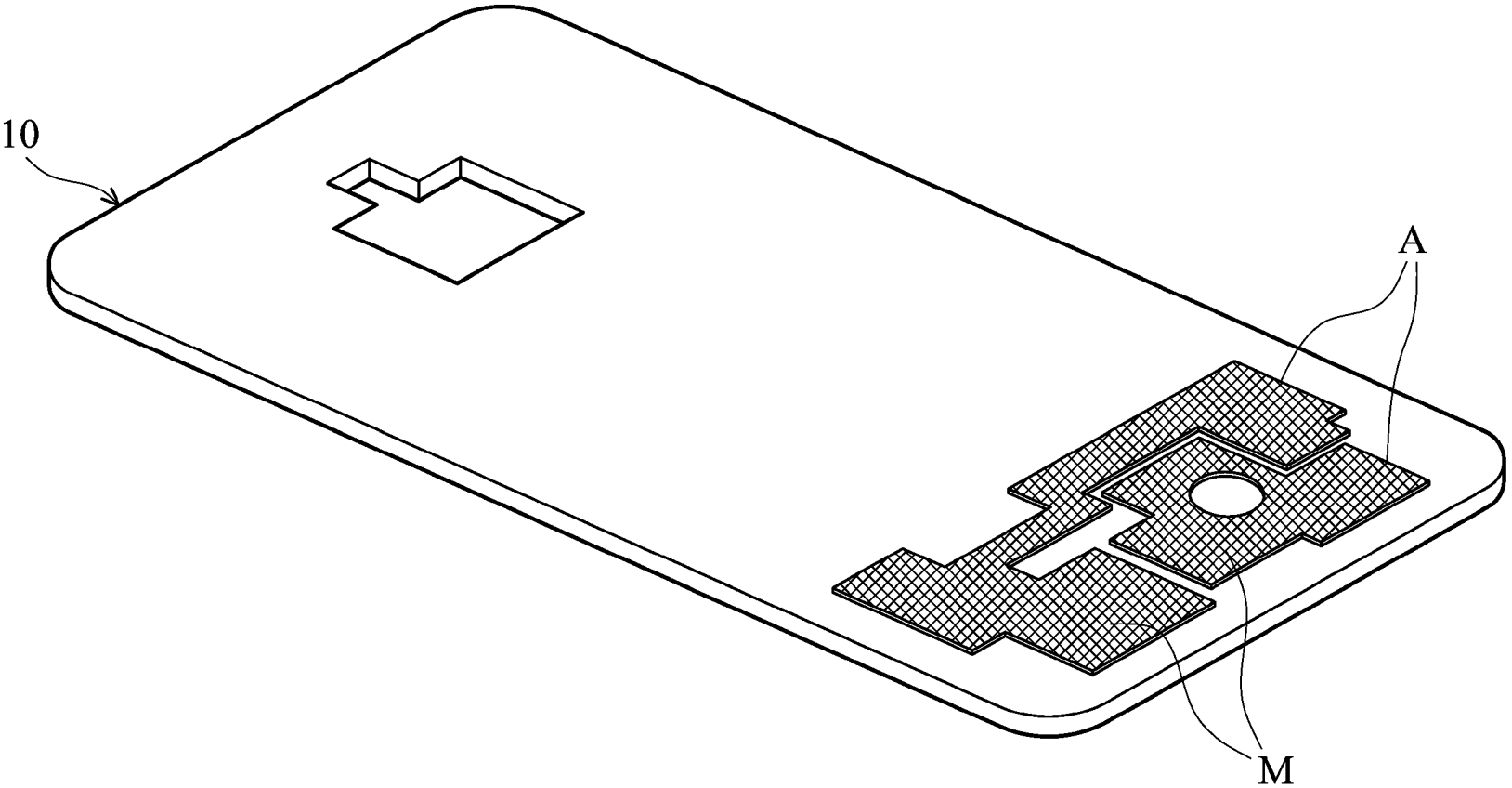
FIG. 4 is a perspective diagram of a metal layer formed on the medium layer.

Before forming the antenna, the plating resist material 20 on the non-conductive frame 10 can be removed using acid or alkali. Subsequently, a metal layer M can be formed on the medium layer P by electroless deposition, as shown in FIG. 4. In this embodiment, the metal layer M may comprise Cu or Ni as the patterned antenna, which is consistent with the predetermined region A. Since the roughened surface within the predetermined region A is previously formed on the non-conductive frame 10 by laser marking, the medium layer P with Pb or Ag can be firmly bonded to the non-conductive frame 10 thorough the roughened surface, and the metal layer M can also be effectively adhered to the non-conductive frame 10 through the medium layer P to form the patterned antenna.

Figure 5:
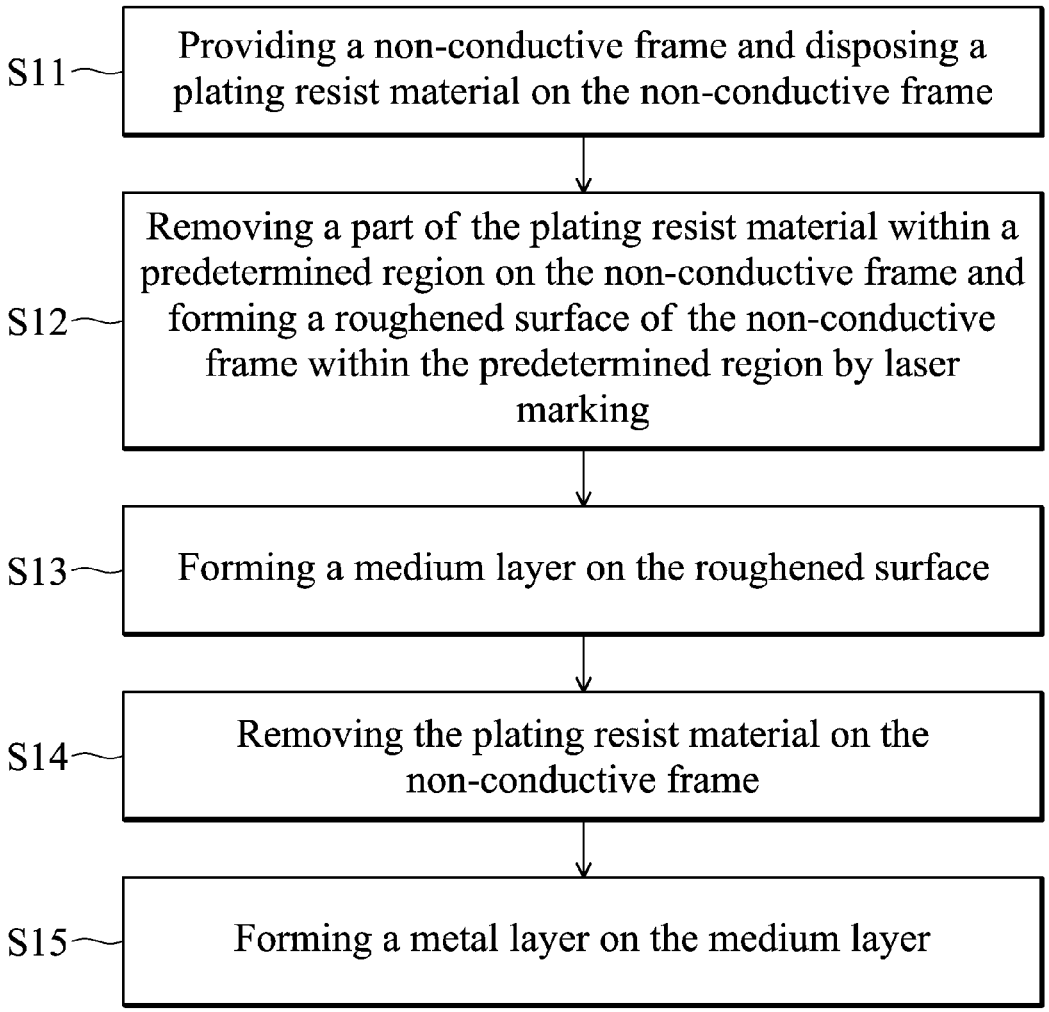
FIG. 5 illustrates a method for forming an antenna structure according to an embodiment of the invention.

FIG. 5 illustrates the method for forming an antenna structure, which primarily comprises the following steps of: providing a non-conductive frame and disposing a plating resist material on the non-conductive frame (step S11), removing a part of the plating resist material within a predetermined region on the non-conductive frame and forming a roughened surface on the non-conductive frame within the predetermined region by laser marking (step S12), forming a medium layer on the roughened surface (step S13), removing the plating resist material on the non-conductive frame (step S14), and forming a metal layer on the medium layer (step S15). It is noted that the plating resist material can be removed (step S14) either before or after formation of the metal layer on the medium layer (step S15). The patterned antenna structure can be produced by forming the metal layer M to be consistent with the predetermined region A.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A method for forming an antenna structure, comprising:

providing a non-conductive frame and disposing a plating resist material on the non-conductive frame;

removing a part of the plating resist material within a predetermined region on the non-conductive frame and forming a roughened surface on the non-conductive frame within the predetermined region by laser marking;

forming a medium layer on the roughened surface, wherein the medium layer comprises Pd;

removing the plating resist material on the non-conductive frame; and forming a metal layer on the medium layer.

2. The method as claimed in claim 1, wherein the metal layer is formed on the medium layer by electroless deposition.

3. The method as claimed in claim 1, wherein the medium layer comprises Pb/Sn colloid or $AgNO_3$.

4. The method as claimed in claim 1, wherein the plating resist material comprises resin.

5. The method as claimed in claim 1, wherein the non-conductive frame is immersed in the plating resist material to form a resist layer on the non-conductive frame.

6. The method as claimed in claim 1, wherein the plating resist material is sprayed on the non-conductive frame to form a resist layer on the non-conductive frame.

7. The method as claimed in claim 1, wherein the plating resist material is daubed on the non-conductive frame to form a resist layer on the non-conductive frame.

8. The method as claimed in claim 1, wherein the metal layer comprises Cu.

9. The method as claimed in claim 1, wherein the metal layer comprises Ni.

10. The method as claimed in claim 1, wherein the non-conductive frame comprises plastic material integrally formed by injection molding.

11. The method as claimed in claim 1, wherein the plating resist material is removed after forming the metal layer on the medium layer.

12. The method as claimed in claim 1, wherein the plating resist material is removed before forming the metal layer on the medium layer.

* * * * *